United States Patent [19]

Bisch

[11] 4,272,913

[45] Jun. 16, 1981

[54] SIMULATED MONSTER TOY AND GAME

[76] Inventor: Jeffery R. Bisch, 1635 Nineteenth St., Manhattan Beach, Calif. 90266

[21] Appl. No.: 25,476

[22] Filed: Mar. 30, 1979

[51] Int. Cl.[3] ..... A63H 13/02

[52] U.S. Cl. ..... 46/123; 43/62; 46/141; 273/1 R

[58] Field of Search ..... 46/123, 141, 118, 119, 46/3, 4, 145, 146; 273/1 R; 43/62

[56] References Cited

U.S. PATENT DOCUMENTS

| | | | |
|---|---|---|---|
| 667,332 | 2/1901 | Olm et al. | 46/4 |
| 1,025,845 | 5/1912 | Thiberge | 43/62 |
| 1,668,937 | 5/1928 | Brown | 43/62 |
| 3,289,347 | 12/1966 | Ginsberg | 46/4 |
| 4,119,312 | 10/1978 | Todokoro | 273/1 R |

FOREIGN PATENT DOCUMENTS

| | | | |
|---|---|---|---|
| 1091268 | 10/1954 | France | 46/123 |
| 4601 | of 1881 | United Kingdom | 46/4 |

*Primary Examiner*—F. Barry Shay

*Attorney, Agent, or Firm*—Kendrick, Netter & Bennett

[57] ABSTRACT

A simulated monster toy and game includes a base that simulates a lake or sea and a housing joined to the base that simulates a cave at the sea's edge, in which the simulated monster is movably mounted. At the mouth of the cave is a weight-actuated triggering means for the monster. Weights shaped like simulated fish are placed on the weight-actuated trigger until the accumulated weight releases the monster from a cocked position within the cave. Upon release, the monster springs outwardly from the cave, devours the fish weights, and pulls them into the cave with the monster.

3 Claims, 7 Drawing Figures

SIMULATED MONSTER TOY AND GAME

This invention relates to a toy. More particularly, the invention relates to an action toy that tests manual dexterity. The toy is particularly suitable for pre-school-age children.

The new toy embodies the motif of a large object or creature, such as a large sea creature, engulfing smaller objects or creatures such as smaller sea creatures like fish. The large object or creature takes the form of a shell means; the smaller objects or creatures, the form of weights that can actuate or trigger the large object's engulfing or devouring action.

Generally, the new toy includes a triggerable, weight-actuatable, moveable shell means and a weight-actuated trigger means, and weights for actuating the triggering means. Upon triggering, the shell means moves from a first, cocked position to a position covering or engulfing the weights. In the preferred embodiment, the shell means also pulls the weights away from the triggering means.

More particularly, in this toy, the shell means is moveably mounted, and is linked to means for generating its movement. The shell means is moveable to, and releasably lockable in a cocked position. Means for releasably engaging the shell means holds it in the cocked position. From there, the shell means is released by weight-actuated triggering means that includes means for disengaging the means holding the shell means cocked. Upon release of the shell means from the cocked position, the movement-generating means impels the shell means to a position where the shell means covers or engulfs or "devours" the weights. In a preferred embodiment, the shell means then draws the weights away from the weight-actuated triggering means.

The preferred embodiment of the new toy includes: base means; housing means mounted on the base means; shell means moveably mounted in the housing means; means joined to the shell means for impelling the shell means from a cocked position to a devouring or engulfing position; means for releasably engaging and holding the shell means in cocked position; weight-actuated triggering means for releasing the means that hold the shell means cocked; and weights for actuating the triggering means. The housing means has a passage sufficiently large to permit the shell means to pass through in the course of the devouring or engulfing movement. The base means has an opening just outside the passage in the housing means. Fitted within this opening is a weight-receiving means that is linked to the means for releasing the shell means from cocked position. Placement of weights one-by-one on the triggering means eventually depresses that means, and releases the shell means from cocked position. The impelling means then moves the shell means outwardly from the housing means; the shell means cover the weights, and pull them off the triggering means.

In the presently preferred embodiment of the new toy, the shell means appears as a large sea creature such as a whale or other simulated sea monster poised (cocked) in a cave (the housing means). The weights that actuate the engulfing or devouring action of the sea monster are shaped like a boat and small fish. With the boat resting on weight-receiving means, one places as many small fish as possible in the boat before the accumulated weight triggers the monster's devouring action. The simulated monster then pulls the weights off the weight-receiving means, and draws them into the housing means beneath the shell of the simulated monster.

The drawings illustrate the presently preferred embodiment of the new toy in detail. In the drawings, FIG. 1 is a perspective view of the new toy;

Figure 1:
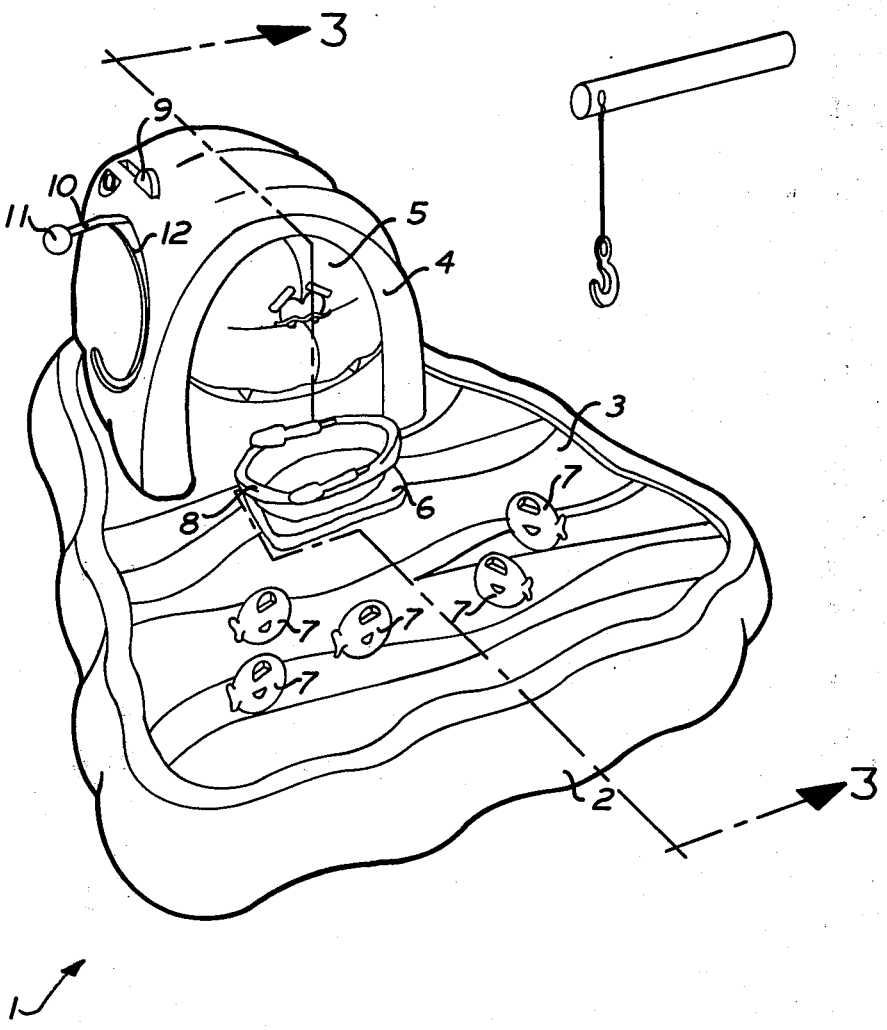

Referring now to the drawings in detail, FIG. 1 shows the presently preferred embodiment of the new toy 1, including base means 2, housing means 4, (sea monster) shell means 5, (fish) weights 7, (boat) weight 8, and weight-receiving means 6. Shell means 5 is moveably mounted (poised) within housing means 4 in the cocked or up position, and is releasably held in that position by releasable locking means 9. Arm means 10, which is linked to shell means 5, moves in slot 12 of housing means 4 to raise shell means 5 to the cocked position shown in FIG. 1.

Figure 2:
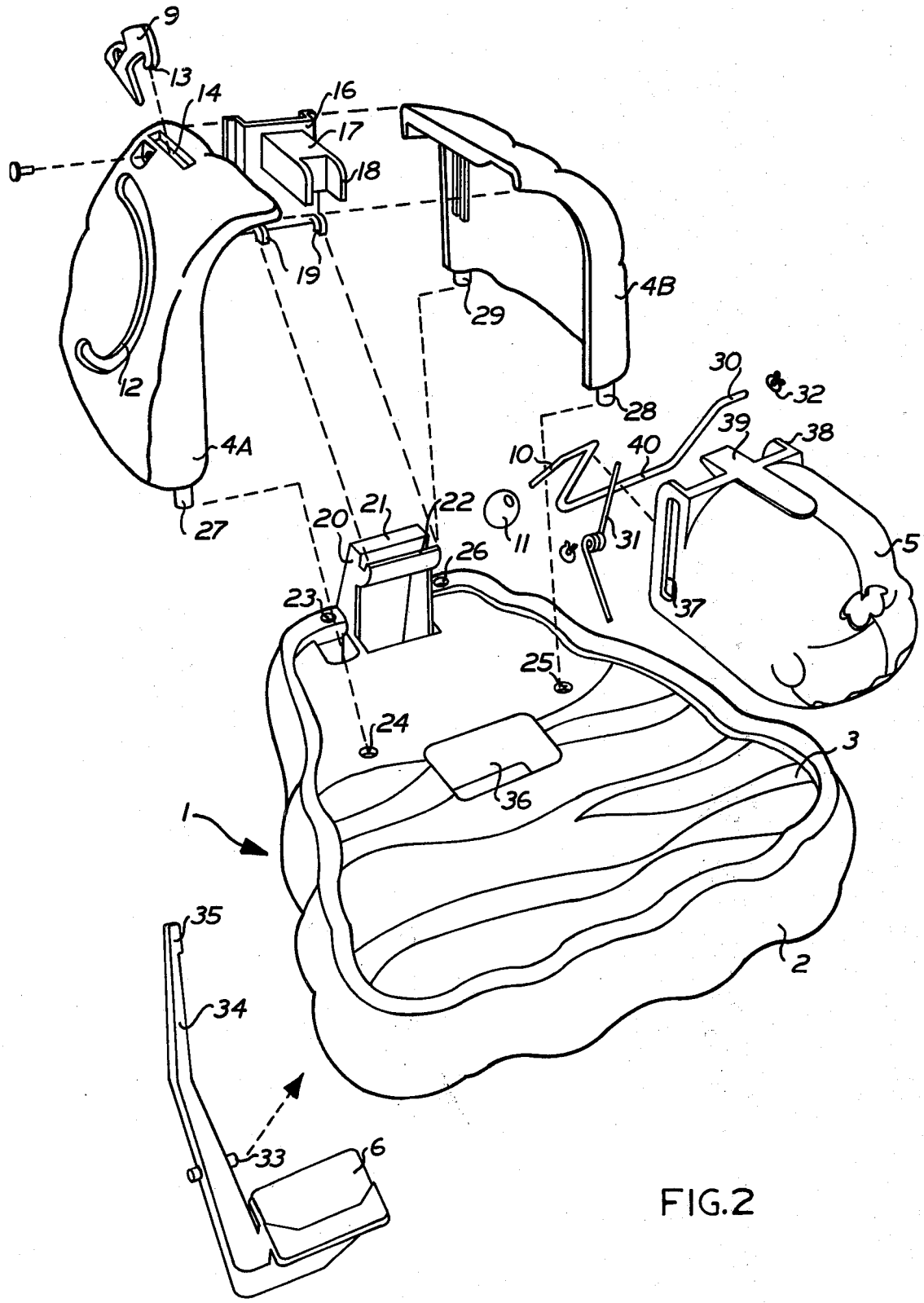
FIG. 2 is an exploded view of the component parts of the toy shown in perspective.

FIG. 2 shows in perspective the component parts of the presently preferred embodiment of the new toy. Housing means 4 is split into two halves 4A and 4B. On the lower edges of halves 4A and 4B are pins 27, 28 and 29 that engage holes 24, 25 and 26 in base means 2. A fourth pin on shell means half 4A (not shown) fits into hole 23 in base means 2. Post 21 is mounted on base means 2 near the rear of housing means 4, and includes upper surface 21 having slot means 22 therein.

Shell means 5 includes elongated slot means 37 and 38 for receiving arm means 10 and 30, respectively of shaft means 40. Clip means 32 and 41 hold arm means 10 and 30, respectively, in elongated slots 37 and 38, respectively. Spring means 31 is joined to shaft means 40, and provides the force to move shell means 5 from the cocked position to the devouring or engulfing position over the weights, then draws shell means 5 with the weights beneath it into housing means 4. Shaft means 40 seats in slot means 22, and is held there by projections 19 at the base of clamping means 16.

Beneath shell means 5 is sliding surface 39 that rides forward and backward on horizontal planar or guiding surface 17, then rides downwardly over guide means 18 as shell means 5 moves into an engulfing position over opening 36 and base means 2.

Figure 3:
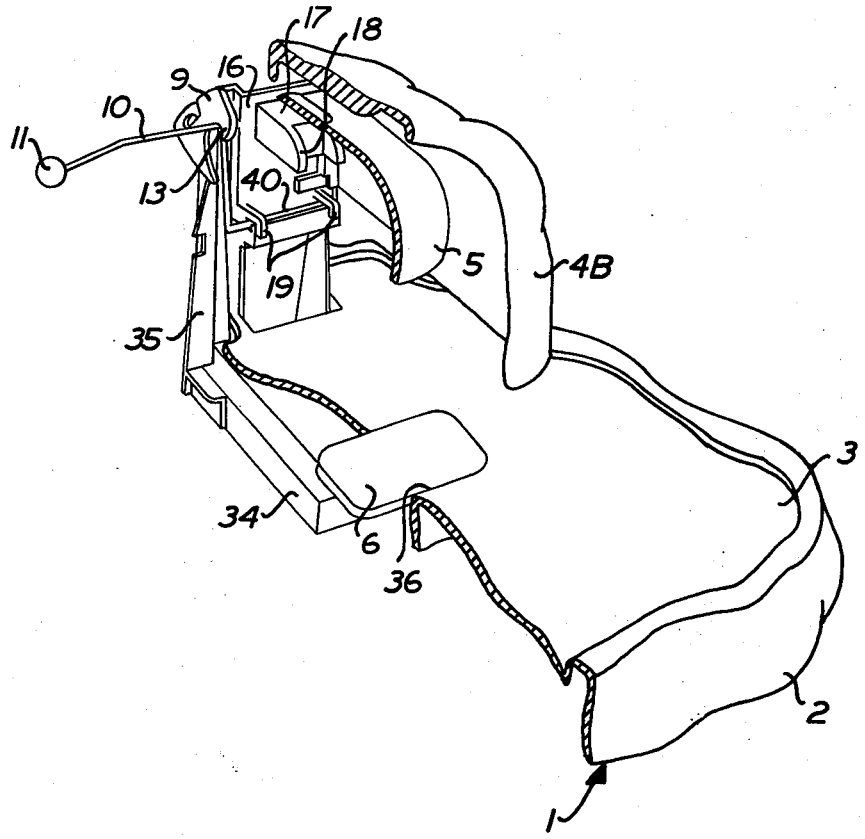
FIG. 3 shows a perspective sectional view of the new toy taken along lines 3—3 in FIG. 1, and shows the shell means in the cocked or up position.

As best seen in FIG. 3, shell means 5 is cocked by rotating arm 40 counterclockwise through and to the top of slot 12. There, flange 13 of releasable engaging means 9 rotates forward to engage arm means 10 and holds shell means 5 in a cocked position.

Figure 4:
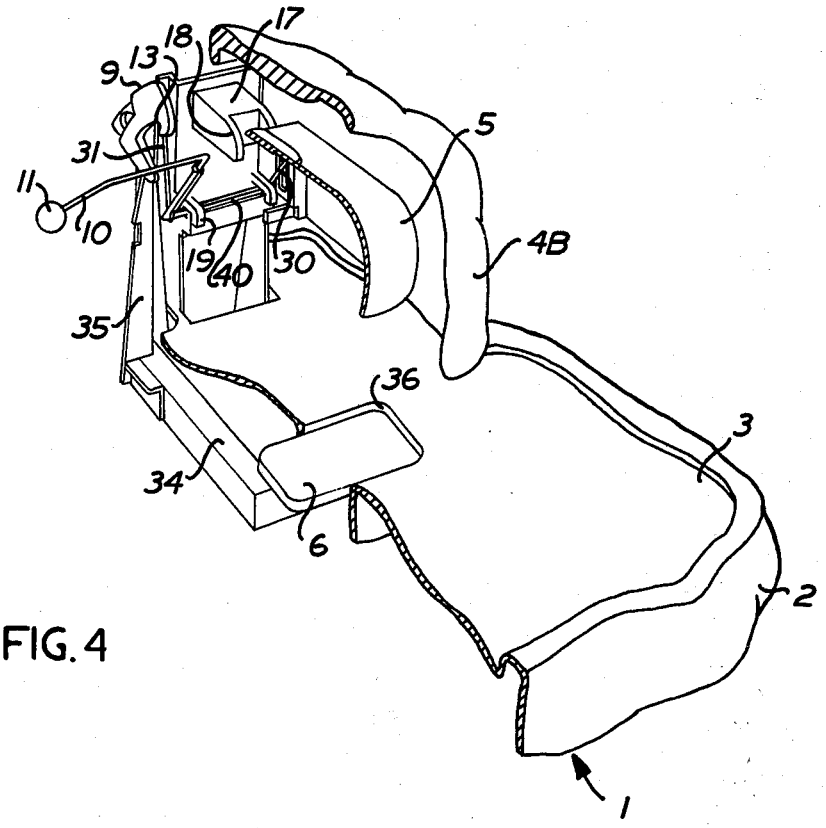
FIG. 4 shows the same perspective view as FIG. 3, but with the shell means released from the cocked position and moving forwardly toward the weight receiving means.
Figure 5:
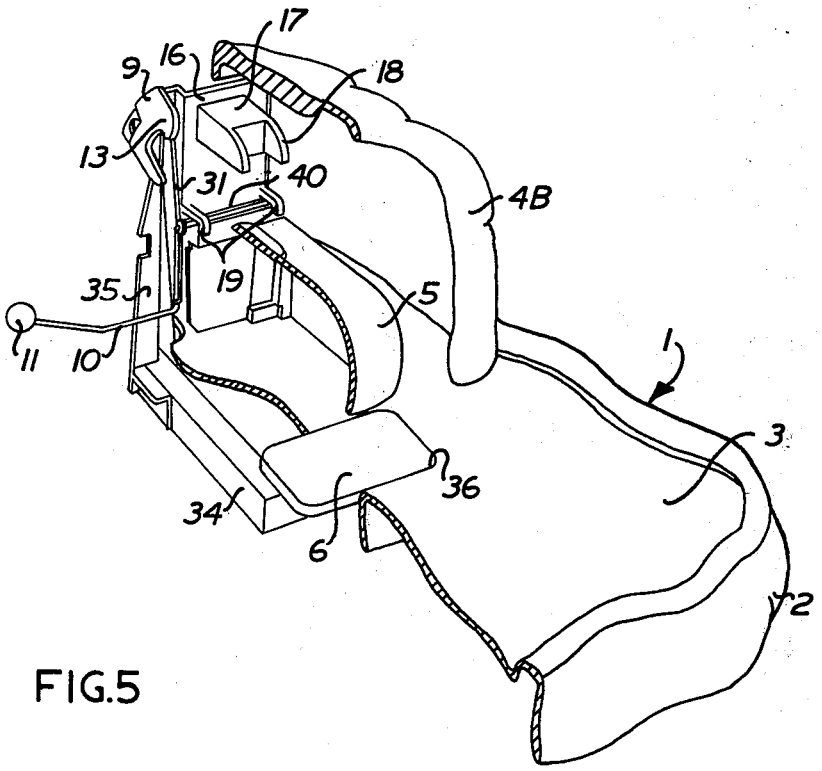
FIG. 5 is another sectional perspective view taken along lines 3—3 of FIG. 1 but with the shell means in the down position following completion of the devouring action.
Figure 6:
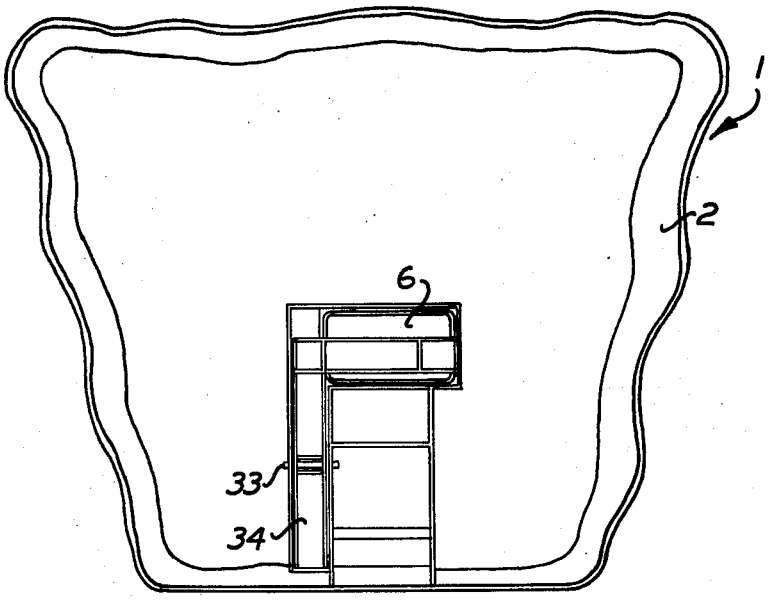
FIG. 6 is a bottom elevational view of the new toy of this invention.
Figure 7:
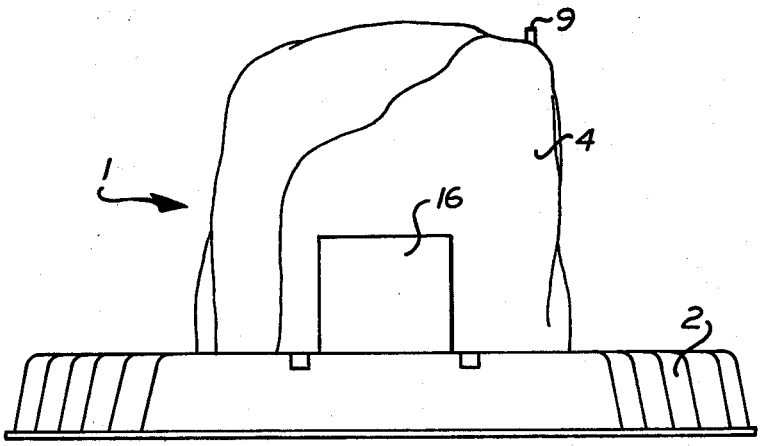
FIG. 7 is a rear elevational view of the new toy.

Accumulation of weights on weight-receiving means 6 depresses that means downwardly in opening 36 (See FIGS. 4 and 6), tilting arm means 34, which is joined to means 6, through pivot means 33. Arm means 35, which is joined to arm means 34, moves upwardly toward member 9 on flange 13. Upon contact with member 9 on flange 13, arm 35 disengages flange portion 13 of releasable means 9 from arm means 10, releasing shell means 5 from the cocked position. Thereupon, as shell means 5 moves forward, surface 39 below shell means 5 moves forwardly along horizontal guiding surface 17, downwardly over sloping guiding surface 18, and then into position over the weights on weight-receiving means 6.

From its position covering the weights, shell means 5 moves off weight-receiving means 6, and backwardly into housing means 4, all under the action of spring means 31. From there, rotation of arm means 10 through slot means 12 moves shell means 5 to the upper or cocked position again. There, flange portion 13 once again releasably engages arm means 10 to hold shell means 5 in cocked position, readying the toy for another "devouring" cycle.

What is claimed is:

1. A toy including at least two toy weights and shell means movably mounted on base means, said base means including a generally horizontal surface having an opening, means for holding said shell means cocked, weight-actuated means for triggering release of said shell means from cocked position including depressible weight-receiving means mounted in said opening on said base means within reach of said shell means and cocking release means joined to said weight-receiving means, said weight-receiving means being adapted to actuate said cocking release means when a number of said toy weights sufficient to depress said weight-receiving means is placed on said weight-receiving means, and means for moving said shell means forward from cocked position to a position covering said toy weights, and then moving said shell means and covered weights to a position where said toy weights no longer exert force on said weight-receiving means.

2. A toy including housing means and shell means movably mounted in said housing means on said toy, means for holding said shell means cocked within said housing means, weight-actuated means for triggering release of said shell means from cocked position including weight-receiving means mounted on said toy within reach of said shell means and cocking release means joined to said weight-receiving means, said weight-receiving means being adapted to actuate said cocking release means when sufficient weight is exerted on said weight-receiving means, and means for moving said shell means forward from cocked position to a position at least partly outside said housing means and covering the weight that triggers said release.

3. A toy including base means for supporting said toy, housing means joined to said base means, spring-loaded shell means mounted in said housing means, means for releasably engaging and holding said housing means, means for releasably engaging and holding said spring-loaded shell means in cocked position within said housing means, and weight-actuated means including weight-receiving means mounted in said base means and cocking release means joined to said weight-receiving means, said weight-receiving means being adapted to actuate said cocking release means when sufficient weight is exerted on said weight-receiving means, wherein said shell means is movable under spring force upon release from cocked position to a position covering said weight-receiving means at least partly out of said housing means.

* * * * *